US005187930A

United States Patent [19]

Stahlecker

[11] Patent Number: 5,187,930

[45] Date of Patent: Feb. 23, 1993

[54] ARRANGEMENT FOR SPINNING STAPLE FIBERS INTO A YARN

[75] Inventor: Fritz Stahlecker, Bad Überkingen, Fed. Rep. of Germany

[73] Assignee: Hans Stahlecker, Fed. Rep. of Germany

[21] Appl. No.: 710,564

[22] Filed: Jun. 5, 1991

[30] Foreign Application Priority Data

Jun. 12, 1990 [DE] Fed. Rep. of Germany ..... 4018702

[51] Int. Cl.[5] ..... D01H 4/02

[52] U.S. Cl. ..... 57/400; 57/403; 57/408

[58] Field of Search ..... 57/400, 401, 403, 404, 57/406, 407, 409, 412, 333, 328

[56] References Cited

U.S. PATENT DOCUMENTS 4,044,537 8/1977 Negishi et al. ..... 57/406
4,676,062 6/1987 Brockmanns et al. ..... 57/401
4,724,668 2/1988 Wassenhoven ..... 57/400 X

FOREIGN PATENT DOCUMENTS 0236324 9/1987 European Pat. Off. .
3624190 1/1987 Fed. Rep. of Germany .
2360695 3/1978 France .
2178451 2/1987 United Kingdom ..... 57/400

*Primary Examiner*—Joseph J. Hail, III
*Attorney, Agent, or Firm*—Evenson, Wands, Edwards, Lenahan & McKeown

[57] ABSTRACT

An arrangement is disclosed for spinning staple fibers to a yarn which has a feeding and opening device which opens up fiber material supplied in the form of slivers into a individual fibers, and a disk-type collecting element which takes over the separated fibers. It is provided that the collecting element has a conical fiber collecting surface which ascends toward the outside with centrifugal forces assisting in compacting the separated fibers to a composite.

22 Claims, 5 Drawing Sheets

FIG. 3
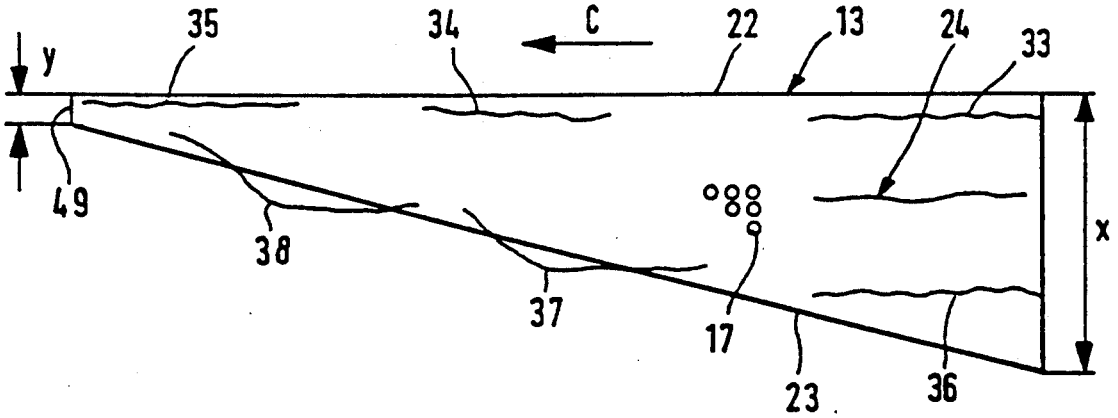
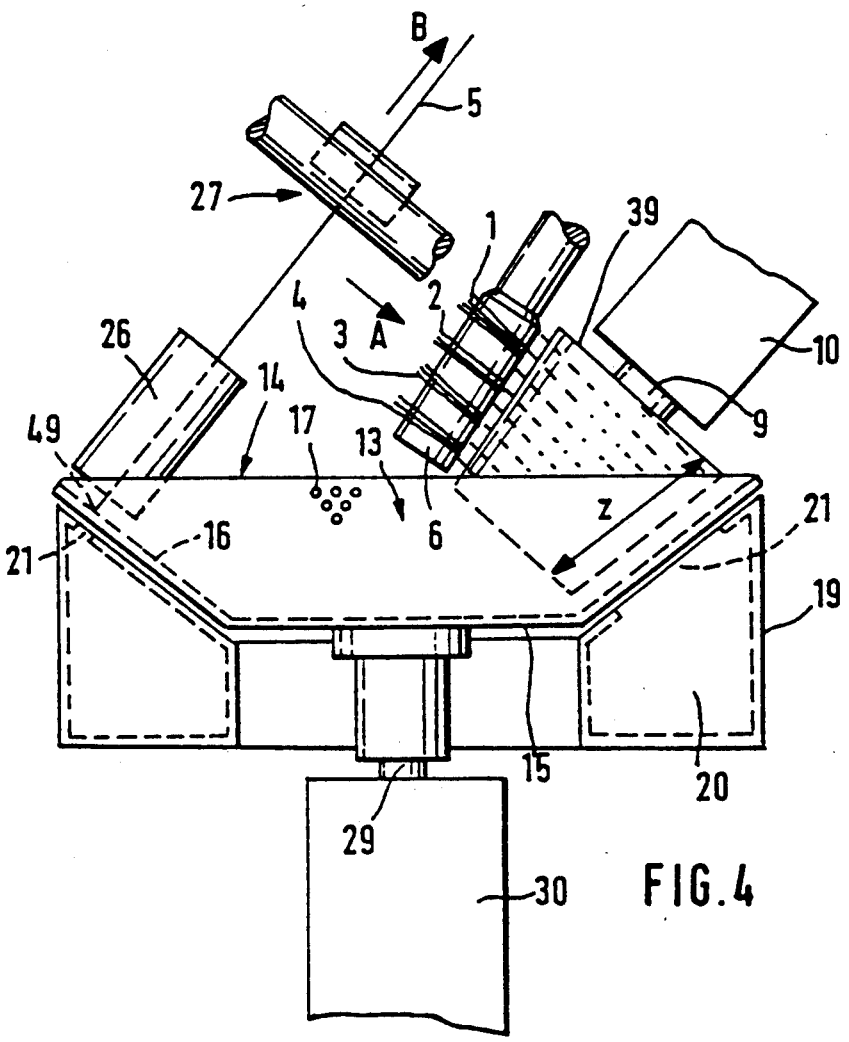
FIG. 4

ARRANGEMENT FOR SPINNING STAPLE FIBERS INTO A YARN

BACKGROUND AND SUMMARY OF THE INVENTION

This invention relates to an arrangement for spinning staple fibers into a yarn of the type having a feeding and opening device which opens up fiber material supplied in the form of a sliver into individual fibers. A disk-shaped collecting element takes over the separated yarns and has a rotating, air permeable collecting surface which is aligned approximately tangentially with respect to an opening roller of the feeding and opening device. A suction device is assigned to the collecting surface on the side facing away from the opening roller and facing the collecting surface by means of a suction slot which tapers in the circumferential direction to a withdrawal point which is followed by a twisting element and a withdrawal device.

In an arrangement of the initially mentioned type (German Patent Document DE-A 36 24 190), the drafting of the fed fiber material to the desired yarn size takes place with the opening-up into individual fibers. The separated fibers are then guided to the collecting surface already in an amount which corresponds to the yarn size to be spun so that a subsequent doubling is no longer required. The separated fibers are bundled to form a fiber composite only transversely to the direction of their continued transport. In the case of the known construction, a flat, plane disk (FIG. 25) is arranged as the collecting element from which the fiber composite is withdrawn against the rotating direction of the disk while a twist is introduced. In this construction, the fibers are held exclusively by the effect of the suction device against the centrifugal force which exists because of the rotation of the disk. In another embodiment, the fibers are fed from the outside onto a conical rotation body which is provided with a suction device on the inside. In this embodiment, the fibers are also held against the centrifugal forces only by the suction effect. In another embodiment (FIG. 27), the fibers are fed to the interior surface of a cylindrical collecting element. In this construction, the interior surface supports the fibers against the centrifugal force. In this case, the collecting of the fibers takes place exclusively by means of the effect of the suction slot tapering in the transport direction.

It is also known (French Patent Document FR-A 23 60 695) to feed the separated fibers, by way of a fiber feeding duct, following an opening roller of a feeding and opening device, into a rotor which has a wall which ascends toward the outside in a truncated-cone-shaped manner. As a result of the centrifugal force, the fibers are to ascend over the edge of the rotor after which they are collected in a stationary collecting groove from which they are withdrawn through a rotating element.

It is also known (European Patent Document EP-B 0 236 324) to feed the fibers separated by a feeding and opening device to a moving collecting surface on which they are doubled so that the desired yarn size is obtained. The collecting surface will then advance the fiber composite to a withdrawal point at which, while being rotated at the same time, the fiber composite is withdrawn into the direction in which it is fed. In this case, the withdrawal speed corresponds essentially to the speed at which the fiber composite is fed by the collecting surface.

It is an object of the invention to provide an arrangement of the initially mentioned type in which the centrifugal forces participate in the compacting of the separated fibers to a fiber composite while, however, the holding of the fibers against the centrifugal forces does not have to be carried out exclusively by the effect of the suction device.

This object is achieved according to preferred embodiments of the present invention in that the disk-shaped collecting element is provided with a conical area which ascends toward the outside and is constructed as a fiber collecting surface.

In this construction, the centrifugal forces participate in the compacting of the separated fibers to a fiber composite while, however, at the same time, the fiber collecting surface supports the fibers at least partially against the centrifugal forces so that a lower air throughput is required for the suction device.

In a further development of the invention, it is provided that the collecting element is constructed in the shape of a bowl, the edge area of which serves as the fiber collecting surface. In a further development of the invention, it is provided that the bowl has a vertical axis of rotation and the fiber collecting surface ascends toward the outside and upward. This has the advantage that the gravitational force affecting the fibers partially counteracts the centrifugal forces so that a further reduction of the power consumption is possible with respect to the suction device.

In a further development of the invention, it is provided that the fiber collecting surface is bounded toward the outside by means of a collecting groove. This collecting groove is used on the one hand as a safety measure to prevent fiber losses by a throwing-off of fibers from the collecting surface while, on the other hand, it improves the collecting operation. It is preferable and expedient for the suction slot to end in front of the withdrawal point. As a result, it is ensured that all fibers are collected in the collecting groove.

In a further development of the invention, it is provided that a roller is arranged at the withdrawal point of the fiber collecting groove which is situated opposite the fiber collecting surface. The withdrawal point can be exactly defined by means of this roller.

In a further development of the invention, it is provided that the roller is loaded by means of an elastic contact pressure device in the direction of the collecting surface.

The roller presses against the collecting surface with a relatively slight force in the order of 10N. This has the result that the twist introduced by the twisting element is a false twist so that a yarn is created which in principle corresponds to a yarn manufactured by pneumatic false-twist spinning. However, in contrast to the known pneumatic false-twist spinning which operates with drafting units, because of the feeding and opening device, an arrangement is achieved that has a much higher capacity. When the contact pressure is adjusted to be even lower or when the roller is left out completely, the twisting element introduces a true twist into the fiber composite so that then a true-twisted yarn is created.

In a further development of the invention, it is provided that the withdrawal direction of the withdrawal device is essentially tangential to the fiber collecting surface in the area of the withdrawal point and has a moving component which continues the moving component of the fiber collecting surface at the withdrawal point. As a result, it is avoided that a significant deflection of the fiber composite occurs in this area which may cause a tangling of the fibers.

In a further development of the invention, it is provided that a driven suction roller is arranged between the withdrawal device and the withdrawal point, the suction area of which is directed at the travelling yarn and the circumferential speed of which in the travelling direction of the yarn is higher than the withdrawal speed of the withdrawal device. This suction roller takes along, at an increased speed, edge fibers which project or spread away from the fiber composite, that is, at a speed which is higher than the speed of the core of the fiber composite. These spread-away edge fibers which are taken along at an increased speed will then, at the time of the opening-up of the false twist, form wind-around fibers behind the twisting element which provide strength to the spun yarn and which are wound around the yarn core in a very uniform manner.

Other objects, advantages and novel features of the present invention will become apparent from the following detailed description of the invention when considered in conjunction with the accompanying drawings.

BRIEF DESCRIPTION OF THE DRAWINGS

FIG. 3 is a view of the fiber collecting surface, unrolled into a plane, of the bowl-shaped or plate-shaped collecting element according to FIGS. 1 and 2 for explaining the compacting of the fed fibers;

FIG. 4 is a schematic view similar to FIG. 1, showing another embodiment of the invention having a truncated-cone-shaped opening roller;

DETAILED DESCRIPTION OF THE DRAWINGS

Figure 1:
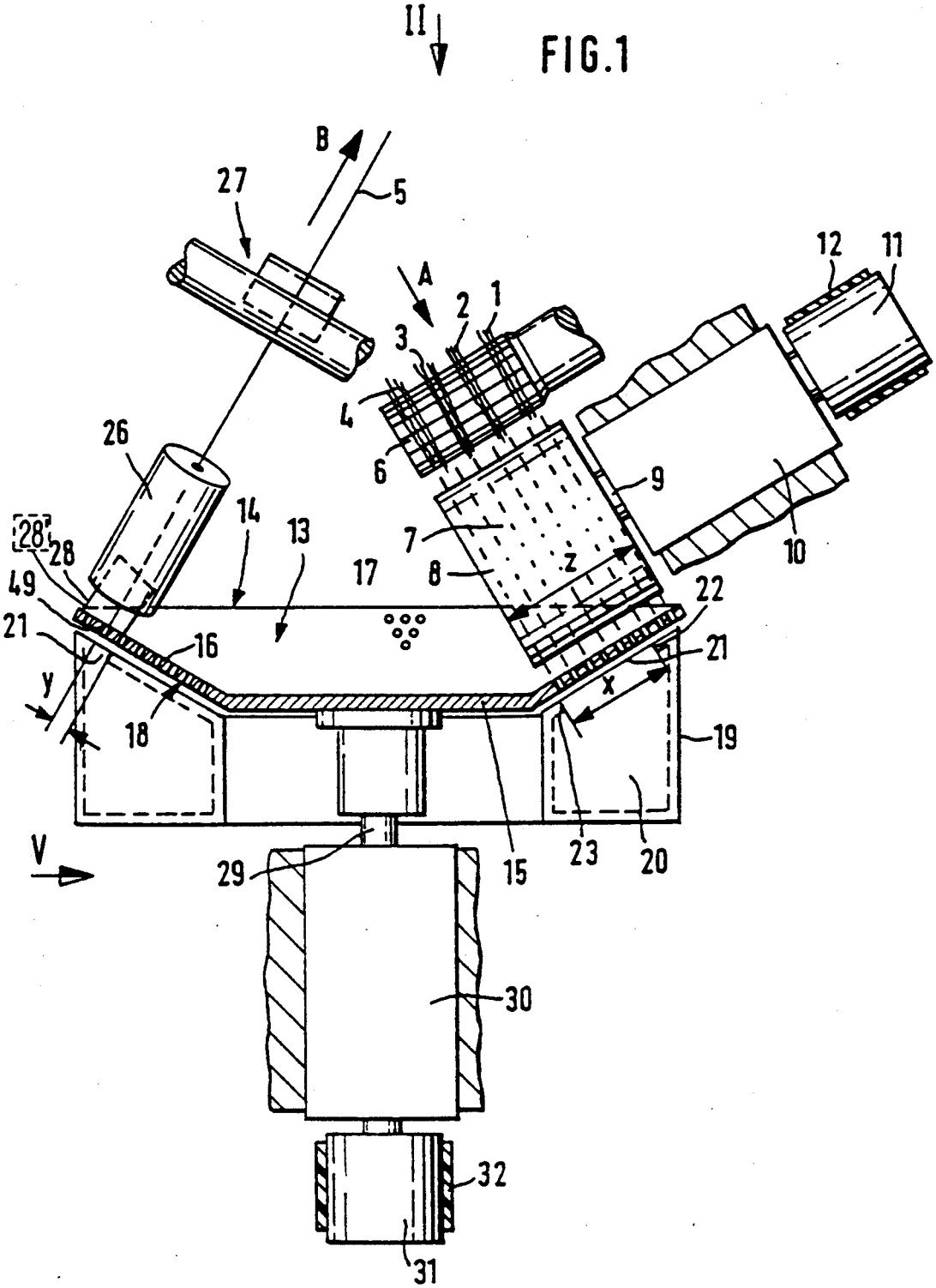
FIG. 1 is a schematic partially axial view of an arrangement by means of which four simultaneously fed slivers are spun into a yarn constructed according to a preferred embodiment of the invention.

The arrangement illustrated in FIG. 1 is a component of a spinning machine which, at least on one side of the machine, is provided with a plurality of arrangements of this type which are arranged in a row. The arrangement comprises a feeding and opening device by means of which four slivers 1, 2, 3, 4, which approach in the direction of the arrow (A) from a feed which is not shown, are fed simultaneously and are opened up into individual fibers which subsequently are spun to a yarn 5 which travels in the direction of the arrow (B) to a wind-up device, which is not shown, and is wound onto a spool package there.

The feeding and opening device comprises a driven feeding roller 6 which, in a manner not shown in detail, interacts with a feeding table and which guides the four slivers 1, 2, 3, 4 simultaneously to an opening roller 7 which is driven at a much higher speed. On its circumference, the opening roller 7 is provided with a mounting of teeth or needles which combs out the slivers 1 to 4 and in the process separates them into individual fibers. By means of a shaft 9, the opening roller 7 is disposed in a bearing housing 10. The shaft 9 is provided with a driving wharve 11 against which a tangential belt 12 moves along which moves through the machine in the longitudinal direction of the machine and simultaneously drives the opening rollers 7 of all arrangements of one side of the machine.

The opening roller 7 which, in a manner not shown in detail, is surrounded by a housing having a delivery opening, transfers the separated fibers to a collecting surface 13 which is arranged approximately tangentially with respect to the circumference of the opening roller 7. The collecting surface 13 is a component of a bowl-shaped or plate-shaped collecting element 14. The collecting element 14, which is open toward the top, by means of a vertical shaft 29, is disposed in a bearing housing 30 which is arranged in a machine frame. On the shaft 29, a driving wharve 31 is arranged which is driven by means of a tangential belt 32 moving through in the longitudinal direction of the machine. The rotational speed of the collecting element 14 is designed such that the collecting surface 13, at the point of its smallest radius facing the opening roller, still has a circumferential speed which corresponds at least to the circumferential speed of the opening roller 7. The collecting element 14 rotates in the direction of the arrow (C) (FIG. 2) in such a manner that the moving direction of the arriving separated yarns remains the same.

The collecting element 14 has a flat plane bottom 15 which is followed by an edge area 16 which is constructed in the shape of a truncated cone and expands in the upward and outward direction. This edge area 16 contains the fiber collecting surface 13. The edge area 16 is provided with a perforation 17. On the underside 18 of the edge area 16, which is opposite the opening roller 7, a stationary suction device 19 is arranged which contains an approximately half-ring-shaped vacuum chamber 20 which, in a manner not shown in detail, is connected to a vacuum source. By way of a suction slot 21, the vacuum chamber 20 is open toward the underside 18 of the edge area 16 by which the course of the fiber collecting surface 13 is formed As shown particularly in FIG. 2, the collecting surface 13 has, in the area in which it takes over the fibers from the opening roller 7, a width (x) in the radial direction which corresponds approximately to the working width (z) of the opening roller 7. In the circumferential direction (C) of the collecting element 14, the fiber collecting surface 13 tapers to a final width (y) which determines a withdrawal point 49. The outer edge 22 of the suction slot 21 describes a circular arc which is coaxial to the collecting element 14. The inner edge 23 extends in a spiral shape toward the outside from the receiving point to the withdrawal point 49. In this area, the suction slot 21 and therefore also the fiber collecting surface 13 still only have a narrow width (y) which is in the range of a few millimeters, that is, in the order of 5 mm and less.

The fibers arriving from the opening roller 7 are taken over as individual fibers 24 in the starting area of the suction slot 21 and are then compacted or bundled to a fiber composite 25 on their way to the withdrawal point 49. In this case, there will no longer be any doubling, that is, the individual fibers 24 are supplied to the collecting element 14 already in an amount which corresponds to the number of fibers in the cross-section of the spun yarn 5. A doubling takes place with the feed of several slivers (1 to 4), that is, before the opening up into individual fibers 24.

The movements of fibers 24 on the fiber collecting surface 13 are illustrated by means of FIG. 3. The separated fibers 24 coming from the opening roller 7 are fed to the fiber collecting surface 13 largely uniformly distributed over the whole initial width (x). The fibers 33, 34, 35 deposited on the outer circumferential area remain essentially in the position in which they were deposited. As a result of the friction force generated between them and the fiber collecting surface 13 because of the suction effect, they are held against the centrifugal force. The fibers 36, 37, 38 arriving in the inner edge area of the fiber collecting surface 13 are first also deposited on the collecting surface 13, which is subjected to suction, and are held in this position. However, as soon as they reach and move beyond the edge 23 of the suction slot 21, the friction force with respect to the fiber collecting surface 13 is reduced so that, as a result of the then predominating centrifugal force, they are moved toward the outside, in which case they largely roll off and retain their straight-line position. Since, in this case, they move into areas of a higher circumferential speed, they are additionally stretched. Thus, at the withdrawal point 49, that is, at the end of the fiber collecting surface 13, a fiber composite or a fiber bundle is created which essentially has the width (y).

At the withdrawal point 49, the fiber composite is withdrawn by means of a withdrawal device 27. The withdrawal speed of the withdrawal device 27 corresponds at least approximately to the circumferential speed of the fiber collecting surface 13 at the withdrawal point 49. In the top view according to FIG. 2, the withdrawal direction (B) extends approximately tangentially to the fiber collecting surface 13 in the area of the withdrawal point 49 and with one moving component in this direction. In order to be able to withdraw the yarn 5 from the plate-shaped collecting element 14, the withdrawal also takes place diagonally in the upward direction.

The withdrawal of the fiber composite 25 at the withdrawal point 49 takes place while introducing a twist into the fiber composite. For this purpose, a twisting element 26, preferably a pneumatic twisting element, which in a known manner consists of one or two pneumatic twisting nozzles, is arranged between the withdrawal point 49 and the withdrawal device 27.

In order to be able to precisely define the withdrawal point 49, as shown in FIG. 1, a roller 28 is arranged in this area which is pressed by means of a preferably adjustable contact pressure force controller 28, against the truncated-cone-shaped edge area 16 of the collecting element 14 at the withdrawal point 49. The roller 28 provides that the twist introduced by the twisting element 26 does not run back into the fiber composite 25 by way of the withdrawal point 49. Thus, a yarn 5 is created which, with respect to its characteristics, corresponds to a false-twisted yarn, that is, a yarn with an essentially untwisted yarn core and fiber ends wound around it on the outside. If, on the other hand, the contact pressure force of the roller 28 is reduced or the roller 28 is left out completely, the provided twist can move back into the fiber composite 25 so that a true-twisted yarn 5 is created. It is therefore possible to spin by means of the arrangement a false-twisted yarn or a true-twisted yarn or a mixture of both.

Figure 2:
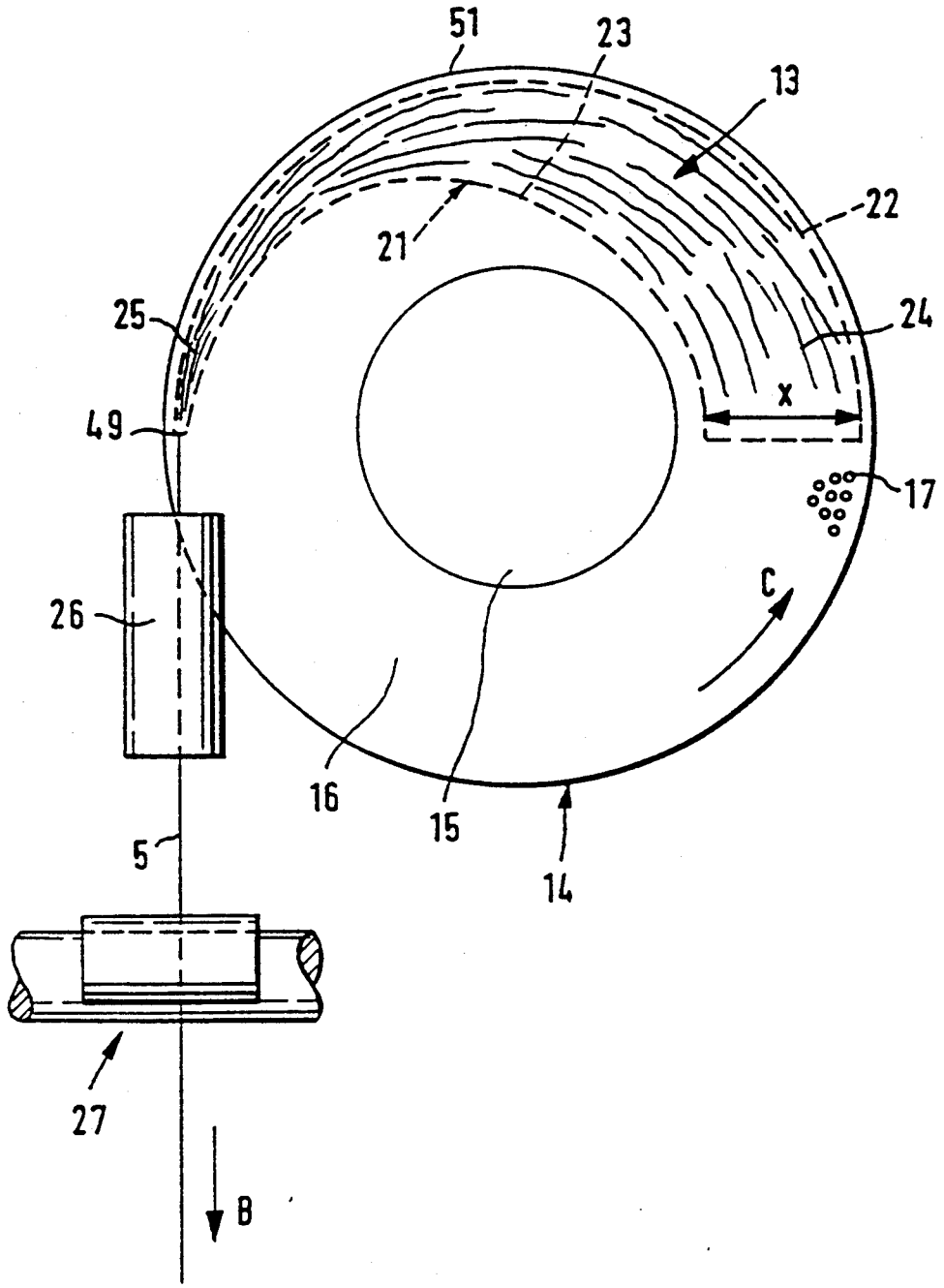
FIG. 2 is a slightly reduced view, taken in the direction of the Arrow II of the arrangement according to FIG. 1, the feeding and opening device having been left out.

The embodiment according to FIG. 4, in its basic principle, corresponds to the embodiment according to FIGS. 1 to 3. However, in the embodiment according to FIG. 4, an opening roller 39 is provided which has a truncated-cone-shaped shell surface. Also in this embodiment, the generating line of this opening roller 39 extends in parallel to the edge area 16 of the collecting element 14. In the case of this type of an opening roller 39, as early as during the combing-out of the slivers (1 to 4), the effect will occur that the separated fibers travel to the area of the larger diameter of the opening roller 39 so that a certain collecting or bundling effect occurs already before the fibers reach the collecting surface 13. It is therefore possible to design the initial width (x) of the fiber collecting surface 13, that is, the width of the suction slot 21, slightly smaller.

Figure 5:
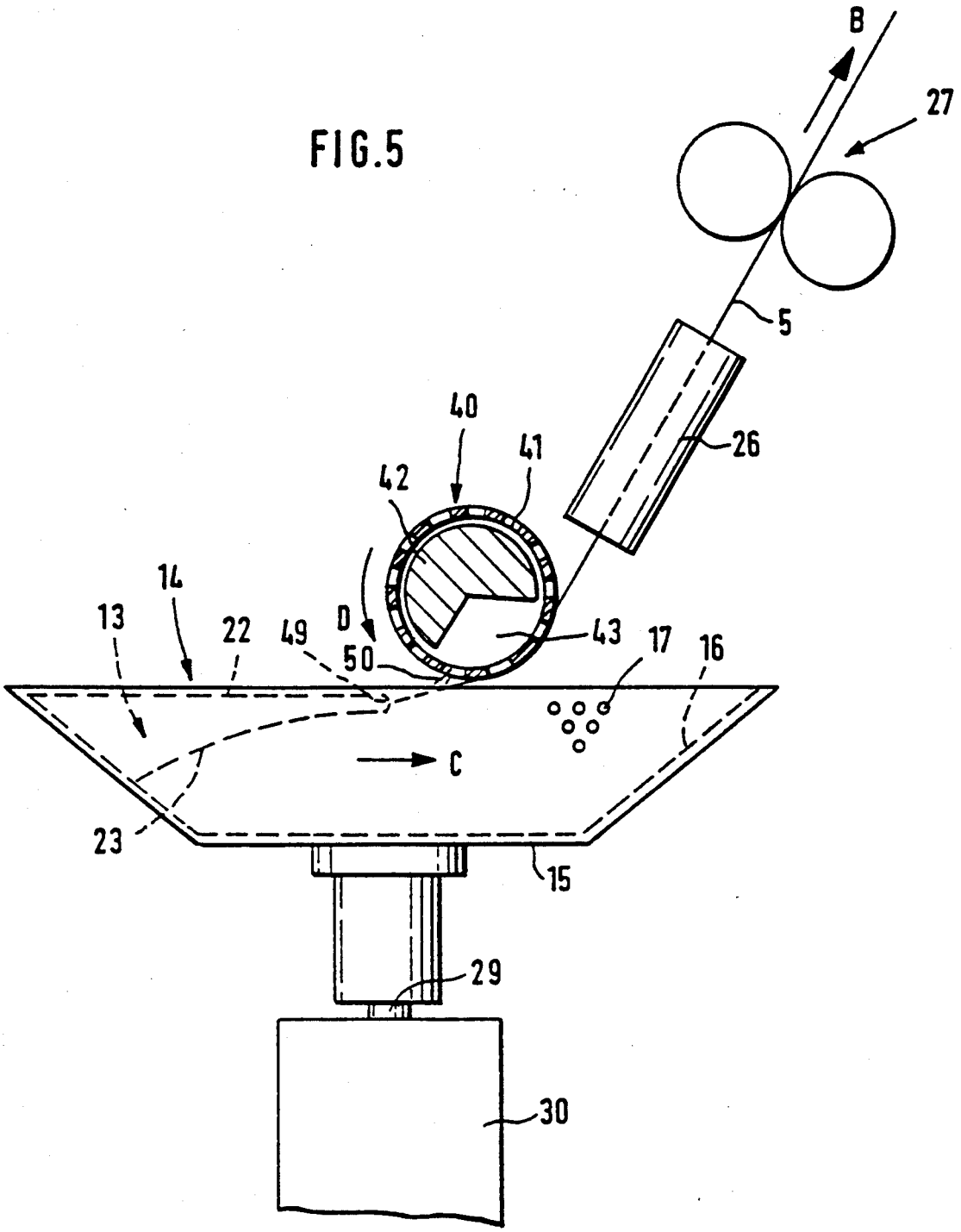
FIG. 5 is a view in the direction of the arrow V of FIG. 1 which, in addition, is equipped with a suction roller arranged between a twisting element and the withdrawal point (for reasons of representation, some components are not shown)

The embodiment according to FIG. 5, in its basic construction, corresponds to the embodiment according to FIGS. 1 to 3. As an addition, in the embodiment according to FIG. 5, a suction roller 40 is arranged between the twisting element 26 and the withdrawal point 49, the axis of the suction roller extending transversely to the travelling direction of the yarn 5. The suction roller 40, which is provided with a perforation 41, comprises a suction insert 42 which is provided with a suction slot 43 which is situated opposite (facing) the area around which the withdrawn yarn 5 winds. The suction roller 40 is driven to a speed which is approximately by one half higher than the withdrawal speed of the withdrawal device 27. The suction roller 40, which rotates in the travelling direction of the yarn (direction of the arrow D), spreads edge fibers 50 away from the fiber composite which subsequently are taken along by the suction roller 40 at an increased speed while the core of the fiber composite or yarn slides over the suction roller 40 at the withdrawal speed. As a result, it is achieved that the edge fibers 50, during the providing of the false twist, are wound around the yarn core with a specified direction so that also subsequently, after the opening-up of the false twist, the edge fibers are wound around the yarn core in a defined manner behind the twisting element 26.

Figure 6:
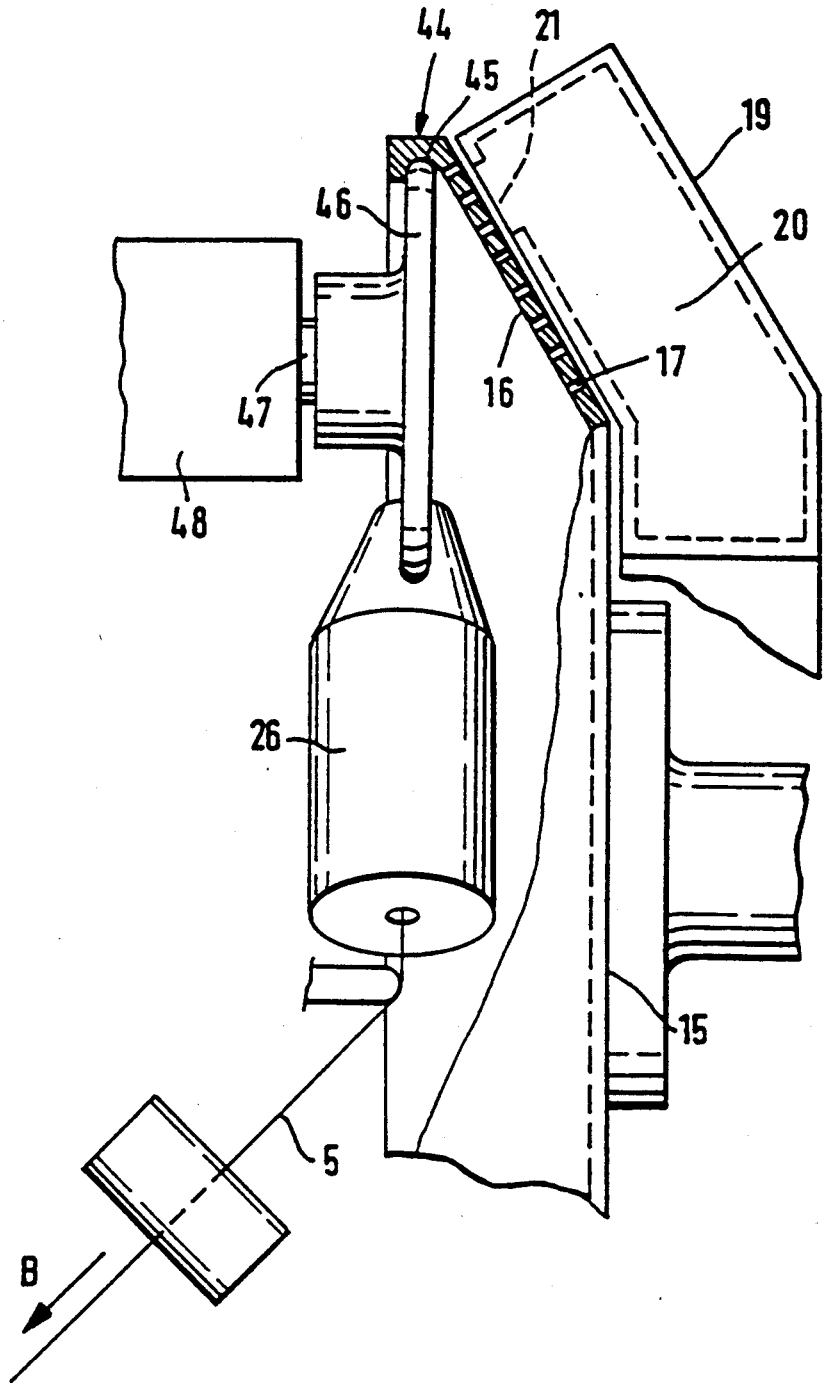
FIG. 6 is a partial view of another embodiment in which the disk-shaped collecting element is provided with a fiber collecting groove at its edge.

In the embodiment according the FIG. 6, which in principle corresponds to the embodiment according to FIGS. 1 to 3, it is additionally provided that the bowl-shaped or plate-shaped collecting element 44, at the outer end of the truncated-cone-shaped edge area 16, is provided with a fiber collecting groove 45. This fiber collecting groove 45 is housed in an edge which follows the truncated-cone-shaped edge area 16 in the axial direction. This fiber collecting groove 45 has the purpose of avoiding the loss of fibers and, in addition, permitting an additional compacting of the fiber composite. In this case, it may be provided that the suction slot 21 ends in the area of the fiber collecting groove 45 or in front of the withdrawal point so that then all fibers will subsequently arrive in the fiber collecting groove 45.

In the embodiment according to FIG. 6, it is also provided that the withdrawal point is defined by a disk-shaped roller 46, the outer contour of which is designed such that it matches the inner contour of the fiber collecting groove 45. The roller 46, which with its shaft 47 is disposed in a bearing housing 48, is driven by friction. By means of the contact pressure force of the roller 46, which is preferably adjustable, the type of the spun yarn 5 is determined. When the roller 46 prevents a runningback of the twist provided by means of the twisting element 26 into the yarn composite, a truly false-spun yarn is obtained. When, on the other hand, the contact pressure force of the roller 46 is so slight (or the roller 46 is completely absent), the provided twist runs back into the fiber composite so that a yarn with a true twist is created. By means of the selection of the contact pressure force, mixed forms can also be produced, that is, a mixed yarn form between a real false-twisted yarn and a completely true-twisted yarn.

The arrangement according to the invention results in a number of advantages. Because of the use of a feeding and opening device of an opening roller, high spinning speeds may be reached, that is, significantly higher speeds than by means of drafting units which cause problems at high speeds. Since the fiber material is fed by means of several individual slivers 1 to 4, a good doubling effect is achieved as early as during the feed. By means of the adjustment of loading forces in the area of the withdrawal point, the character of the yarn may be influenced. By means of the shape of the connecting surface of the collecting element, a fiber loss may be reduced while at the same time the power consumption is also decreased.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for spinning staple fibers into a yarn, comprising:

a feeding and opening device which opens up fiber material supplied in the form of a silver into individual fibers, a bowl-shaped collecting element which receives the separated yarns and has a rotatable air permeable collecting surface which is aligned approximately tangentially with respect to an opening roller of the feeding and opening device, apparatus for rotating the collecting surface, and a suction device assigned to the collecting surface on a side facing away from the opening roller and facing the collecting surface by means of a suction slot which tapers in the circumferential direction to a withdrawal point which is followed by a twisting element and a withdrawal device, wherein the bowl-shaped collecting element is provided with a truncated-cone-shaped edge area which ascends toward the outside and which si constructed as an annularly extending bowl shaped fiber collecting surface on the radial inside of said edge area, wherein the suction device is disposed at the opposite side of said edge area and wherein said yarn is withdrawn from the collecting surface in a direction substantially parallel tot he travel direction of the collecting surface at the withdrawal point.

2. An arrangement according to claim 1, wherein the collecting element is constructed as a bowl with a substantially flat bottom surrounded by the edge area which serves as the fiber collecting service.

3. An arrangement according to claim 2, wherein the collecting element has a vertical axis of rotation, and wherein the fiber collecting surface ascends toward the outside and upwards.

4. An arrangement according to claim 1, wherein the collecting element has a vertical axis of rotation, and wherein the fiber collecting surface ascends toward the outside and upwards.

5. An arrangement according to claim 4, wherein the opening roller has a truncated-cone-shaped design, the angle of slope of which corresponds at least approximately to the angle of slope of the fiber collecting surface of the collecting element.

6. An arrangement according to claim 4, wherein the withdrawal direction of the withdrawal device extends essentially tangentially with respect to the fiber collecting surface in the area of the withdrawal point and has a moving component which continues the moving direction of the fiber collecting surface at the withdrawal point.

7. An arrangement according to one of claim 1, wherein the fiber collecting surface is bounded toward the outside by means of a collecting groove.

8. An arrangement according to claim 7, wherein the collecting groove is arranged in an edge which projects upwardly away from the fiber collecting surface.

9. An arrangement according to claim 8, wherein the suction slot ends in front of the withdrawal point.

10. An arrangement according to claim 8, wherein the axis of the opening roller of the feeding and opening device extends substantially radially and at an inclination with respect to the axis of rotation of the collecting element.

11. An arrangement according to claim 7, wherein the suction slot ends in front of the withdrawal point.

12. An arrangement according to claim 1, wherein the axis of the opening roller of the feeding and opening device extends substantially radially and at an inclination with respect to the axis of rotation of the collecting element.

13. An arrangement according to claim 12, wherein the withdrawal direction of the withdrawal device extends essentially tangentially with respect to the fiber collecting surface in the area of the withdrawal point and has a moving component which continues the moving direction of the fiber collecting surface at the withdrawal point.

14. An arrangement according to claim 1, wherein the opening roller has a truncated-cone-shaped design, the angle of slope of which corresponds at least approximately to the angle of slope of the fiber collecting surface of the collecting element.

15. An arrangement according to claim 1, wherein a control roller is situated opposite the fiber collecting surface at the withdrawal point of the fiber collecting surface.

16. An arrangement according to claim 15, wherein the distance of the control roller to the fiber collecting surface or a collecting groove of the collecting surface can be adjusted by means of a control roller adjusting device.

17. An arrangement according to claim 16, comprising an elastic contact pressure device, wherein the control roller is loaded in the direction of the fiber collecting surface or of a collecting groove of the collecting surface by means of the elastic contact pressure device.

18. An arrangement according to claim 15, wherein the control roller is loaded in the direction of the fiber collecting surface or of a collecting groove of the collecting surface by means of an elastic contact pressure device.

19. An arrangement according to claim 18, wherein the contact pressure force of the elastic contact pressure device is adjustable by means of a contact pressure adjusting device.

20. An arrangement according to claim 1, wherein the withdrawal direction of the withdrawal device extends essentially tangentially with respect to the fiber collecting surface in the area of the withdrawal point and has a moving component which continues the moving direction of the fiber collecting surface at the withdrawal point.

21. An arrangement according to claim 1, wherein a pneumatic false twisting device is arranged between the withdrawal point and the withdrawal device.

22. An arrangement according to claim 1, wherein a driven suction roller is arranged between the twisting element and the withdrawal point, the suction area of which suction roller is directed toward the yarn travel and the circumferential speed of which in the yarn travelling direction is higher than the withdrawal speed of the withdrawal device.

* * * * *